US006457288B2

(12) United States Patent
Zambelli et al.

(10) Patent No.: US 6,457,288 B2
(45) Date of Patent: Oct. 1, 2002

(54) PREFABRICATED CONCRETE PANEL FOR BUILDING FLOORS IN CIVIL OR INDUSTRIAL STRUCTURES

(76) Inventors: Sergio Zambelli, Via Stezzano 28, 24050 Zanica (IT); Benito Zambelli, Via Roma 44, 24050 Zanica (IT)

( * ) Notice: Subject to any disclaimer, the term of this patent is extended or adjusted under 35 U.S.C. 154(b) by 69 days.

(21) Appl. No.: 09/742,562

(22) Filed: Dec. 22, 2000

(30) Foreign Application Priority Data

Feb. 18, 2000 (IT) ..... MI20000A000299

(51) Int. Cl.[7] ..... E04C 2/288; E04C 2/52

(52) U.S. Cl. ..... 52/220.2; 52/220.3; 52/302.3; 52/320; 52/323; 52/576; 52/503; 52/309.12; 52/309.17; 52/405.3; 52/444; 52/793.1

(58) Field of Search ..... 52/220.1, 220.2, 52/220.3, 220.4, 220.5, 220.8, 444, 576, 577, 236.5, 236.8, 252, 259, 320, 322, 323, 302.3, 302.4, 793.1, 309.12, 309.17, 414, 405.1, 405.3, 503, 504, 505

(56) References Cited

U.S. PATENT DOCUMENTS

| | | | | | |
|---|---|---|---|---|---|
| 835,669 | A | * | 11/1906 | Eckley | 52/302.4 |
| 1,038,551 | A | * | 9/1912 | Forsyth | 52/323 |
| 1,729,612 | A | * | 10/1929 | Goldsmith | 52/320 |
| 2,033,751 | A | * | 3/1936 | Yeager | 52/322 X |
| 2,154,390 | A | * | 4/1939 | Akers | 52/220.2 X |
| 3,382,637 | A | * | 5/1968 | Longinotti | 52/320 |
| 3,849,957 | A | * | 11/1974 | Bastgen | 52/327 |
| 3,908,323 | A | | 9/1975 | Stout | |
| 3,999,341 | A | * | 12/1976 | Stout | 52/220.3 |
| 4,037,375 | A | * | 7/1977 | Maggos et al. | 52/220.3 |
| 6,223,480 | B1 | * | 5/2001 | Khoo | 52/236.8 X |
| 6,272,749 | B1 | * | 8/2001 | Boeshart et al. | 52/220.2 X |
| 6,298,622 | B1 | * | 10/2001 | Cretti | 52/309.7 |

FOREIGN PATENT DOCUMENTS

| | | | | |
|---|---|---|---|---|
| DE | 20 14 558 | | 10/1970 | |
| DE | 30 09 378 | | 9/1981 | |
| DE | 32 45 889 | | 6/1984 | |
| FR | 2623227 | * | 5/1989 | 52/220.3 |
| GB | 1007682 | * | 10/1965 | 52/320 |
| WO | 91 00400 | | 1/1991 | |

* cited by examiner

*Primary Examiner*—Laura A. Callo
(74) *Attorney, Agent, or Firm*—Guido Modiano; Albert Josif; Daniel O'Byrne

(57) ABSTRACT

A prefabricated concrete panel for building floors in civil or industrial structures, comprising a concrete body with a reinforcement provided with portions which protrude from one of the larger faces of the body of the panel which constitutes extrados of a floor and are designed to be embedded in the casting of the topping of the floor. At least one first shaped sheet is provided inside the body of the panel, is made of thermally insulating material, is interposed between the two larger faces of the panel body and forms, between the two larger faces of the panel body, a ventilation chamber which is composed of a plurality of mutually connected cells.

23 Claims, 6 Drawing Sheets

PREFABRICATED CONCRETE PANEL FOR BUILDING FLOORS IN CIVIL OR INDUSTRIAL STRUCTURES

BACKGROUND OF THE INVENTION

The present invention relates to a prefabricated concrete panel for building floors in civil or industrial structures.

Prefabricated reinforced-concrete components for building floors are divided into two categories: components for forming ribbed floors, i.e., with ribs on the intrados or underside of the floor, and components for forming flat floors, i.e., with a flat intrados.

Prefabricated components for forming ribbed floors generally have a transverse cross-section which is substantially T-shaped or derives from the mating of two or three T-shapes, depending on whether they have two or three ribbing wings on the intrados.

These components have the advantage of being of low manufacturing costs, but they have several problems, including low thermal and acoustic insulation, since they are made entirely of concrete, and the fact that they form floors with a ribbed intrados which can hardly ever be adopted in structures of the civil type, especially due to the considerable thickness of the ribbing.

Prefabricated components for building flat floors can in turn be divided into three categories: honeycomb components, concrete panels with a thermal insulation layer, and panels with contoured sheets of extruded polystyrene which act as a thermal insulation and provide internal ventilation of the components.

Honeycomb components are constituted by prestressed reinforced concrete panels with reinforcements which lie exclusively longitudinally and with a plurality of uniform longitudinal passages which are not connected one another and are designed to ventilate the inside of the panels, reducing the formation of condensation.

These components suffer the drawback of high thermal conductivity, ventilation which is not always sufficient to avoid temperature unevenness among the various regions of the panel, and high weight. Moreover, in these components prestressing can cause deformations of the components. With these components it is not possible to have through openings in the body of the component.

Concrete panels with a thermal insulation layer are generally constituted by a concrete body which embeds a flat sheet of foamed polystyrene being interposed between the two main faces of the panel. These panels suffer the drawback that they do not effectively oppose the formation of condensation, since they do not have an internal ventilation system.

Concrete panels with contoured sheets of extruded polystyrene are generally constituted by a concrete body having, on its face meant to be covered by the casting of the topping, contoured sheets of foamed polystyrene which form a plurality of longitudinally elongated ventilation channels which are not mutually connected.

These components suffer the drawback that they are generally not walkable before the casting of the topping has been performed and has stabilized. Moreover, the reinforcement can only be constituted by longitudinal rods in order to avoid interrupting the polystyrene which provides the ventilation channels.

SUMMARY OF THE INVENTION

The aim of the present invention is to solve the above-noted problems, by providing a prefabricated concrete panel for building floors in civil or industrial structures which allows to obtain, for the floor, a high thermal and/or acoustic insulation and effectively avoids the formation of condensation inside it.

Within this aim, an object of the invention is to provide a prefabricated panel which is self-supporting and walkable immediately after its installation.

Another object of the invention is to provide a prefabricated panel which has high mechanical strength without requiring prestressing and is therefore particularly simple and rapid to manufacture.

Another object of the invention is to provide a prefabricated panel which also achieves excellent anchoring of the casting of the topping.

Another object of the invention is to provide a panel which allows to produce floors in extremely short times without requiring the use of propping.

Another object of the invention is to provide a prefabricated panel which can be manufactured at competitive costs.

This aim and these and other objects which will become better apparent hereinafter are achieved by a prefabricated concrete panel for building floors in civil or industrial structures, characterized in that it comprises a concrete body with a reinforcement provided with portions which protrude from one of two larger faces of the body of the panel which constitutes extrados of a floor and are designed to be embedded in a casting of a topping of the floor, at least one first contoured sheet being provided inside the body of the panel, said sheet being made of thermally insulating material, being interposed between the two larger faces of the panel body and forming, between said two larger faces of the panel body, a ventilation chamber which is composed of a plurality of mutually connected cells.

BRIEF DESCRIPTION OF THE DRAWINGS

Further characteristics and advantages of the invention will become better apparent from the following detailed description of a preferred but not exclusive embodiment of the prefabricated panel according to the invention, illustrated only by way of non-limitative example in the accompanying drawings, wherein.

DESCRIPTION OF THE PREFERRED EMBODIMENTS

Figure 1:
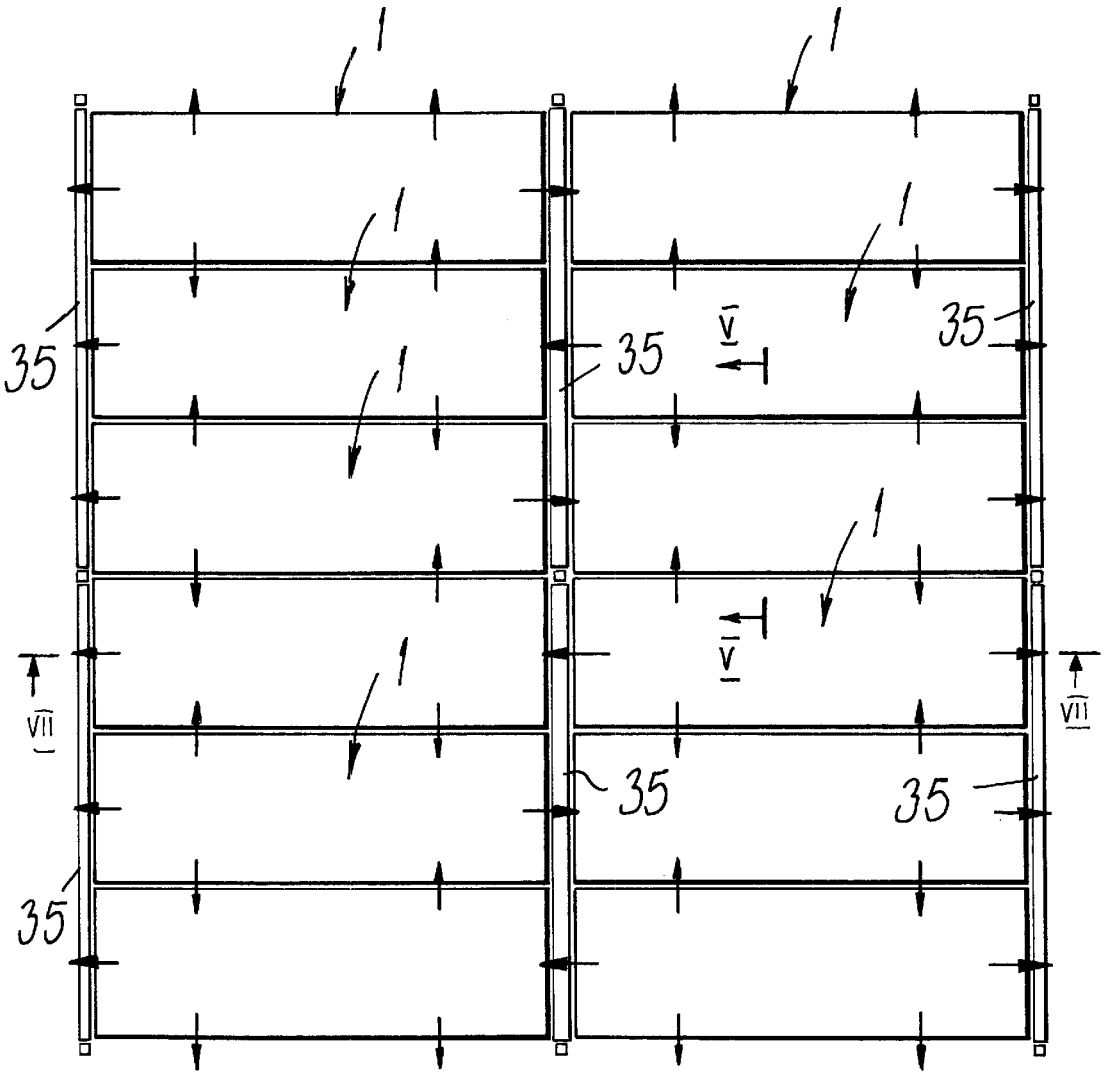
FIG. 1 is a schematic top plan view of a floor built with panels according to the invention.
Figure 2:
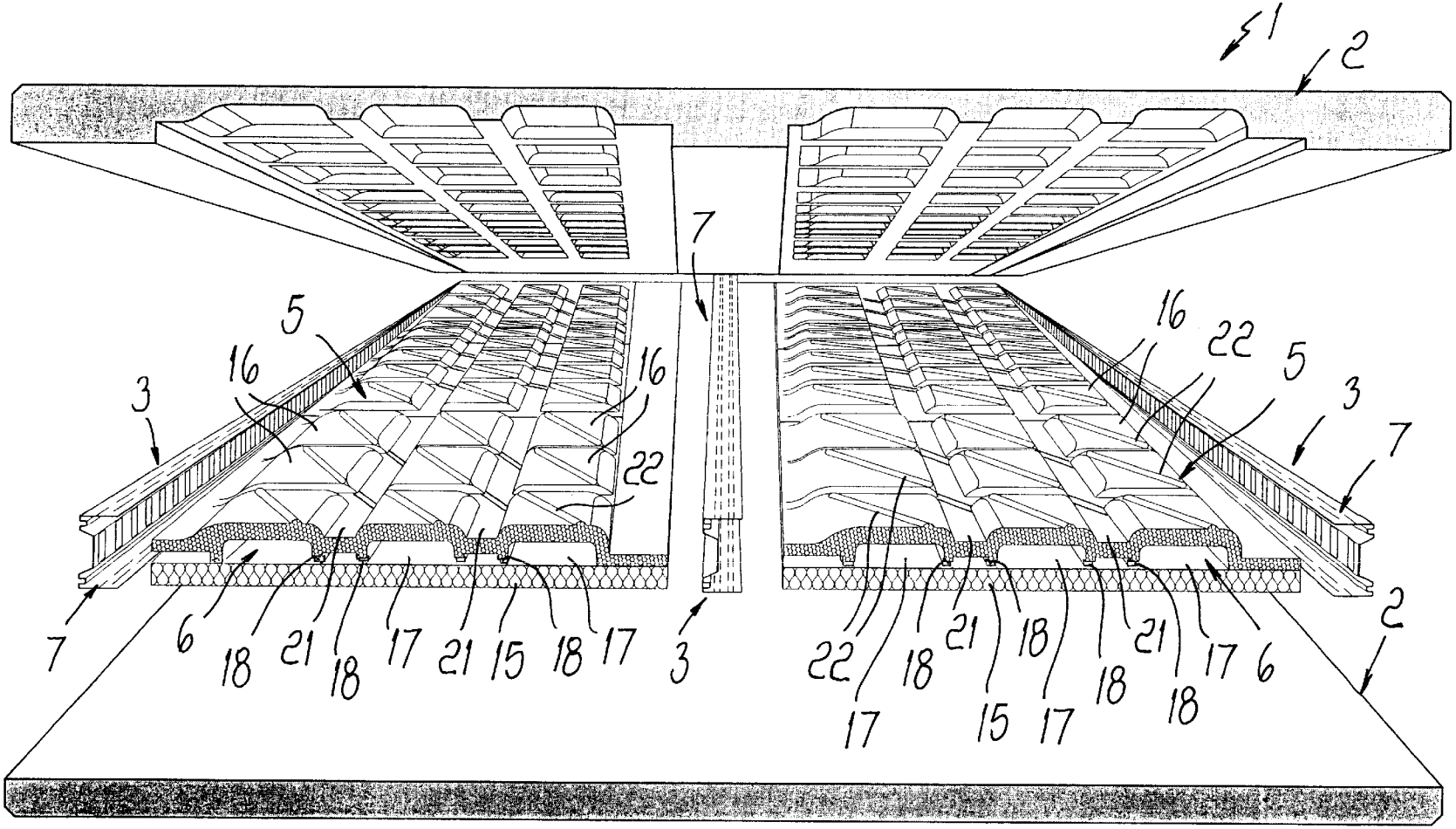
FIG. 2 is a partially sectional exploded perspective view of a panel according to the invention.
Figure 3:
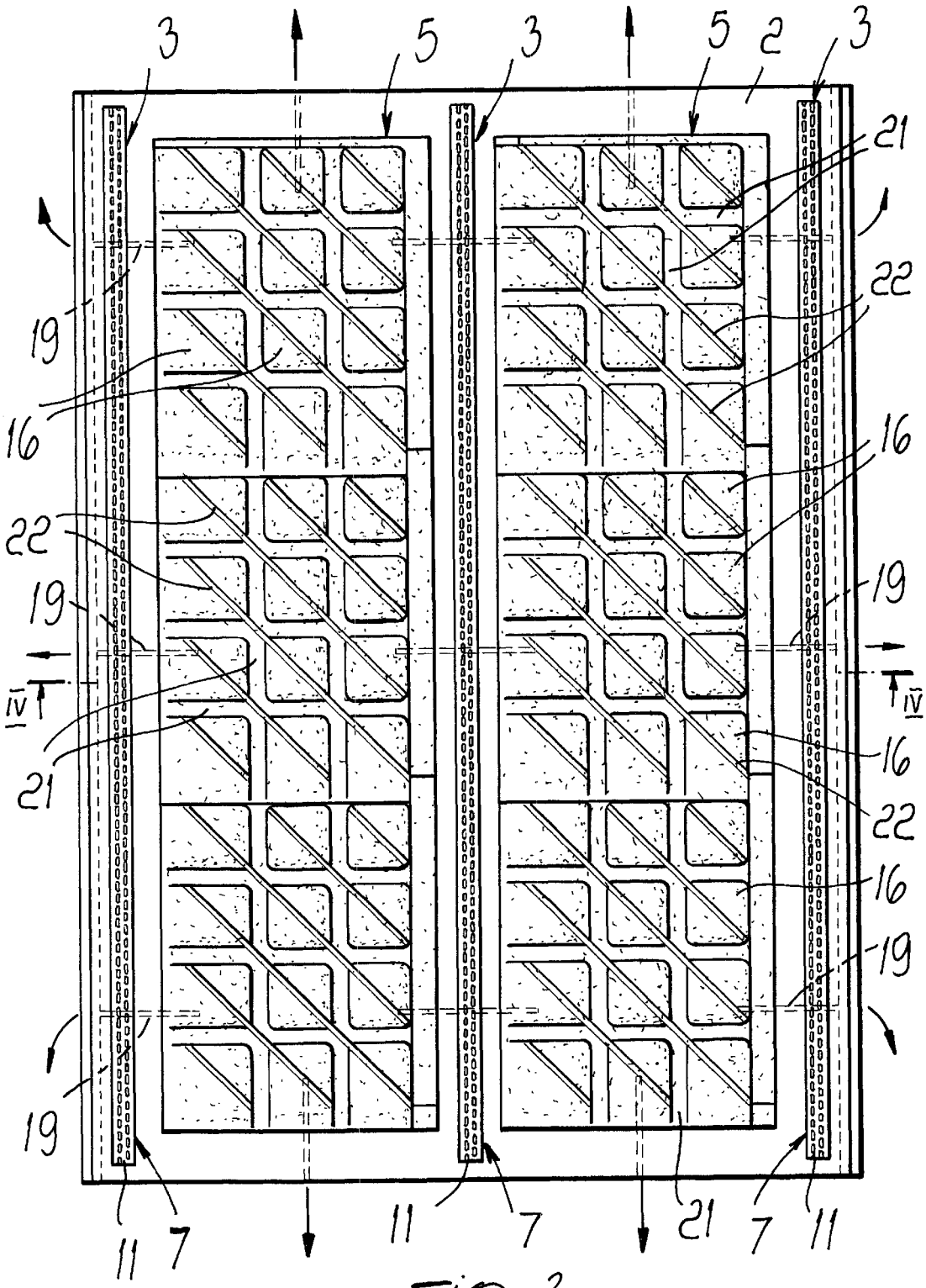
FIG. 3 is a top plan view of a panel according to the invention, with the upper layer of concrete removed in order to illustrate the internal components of the panel.
Figure 4:
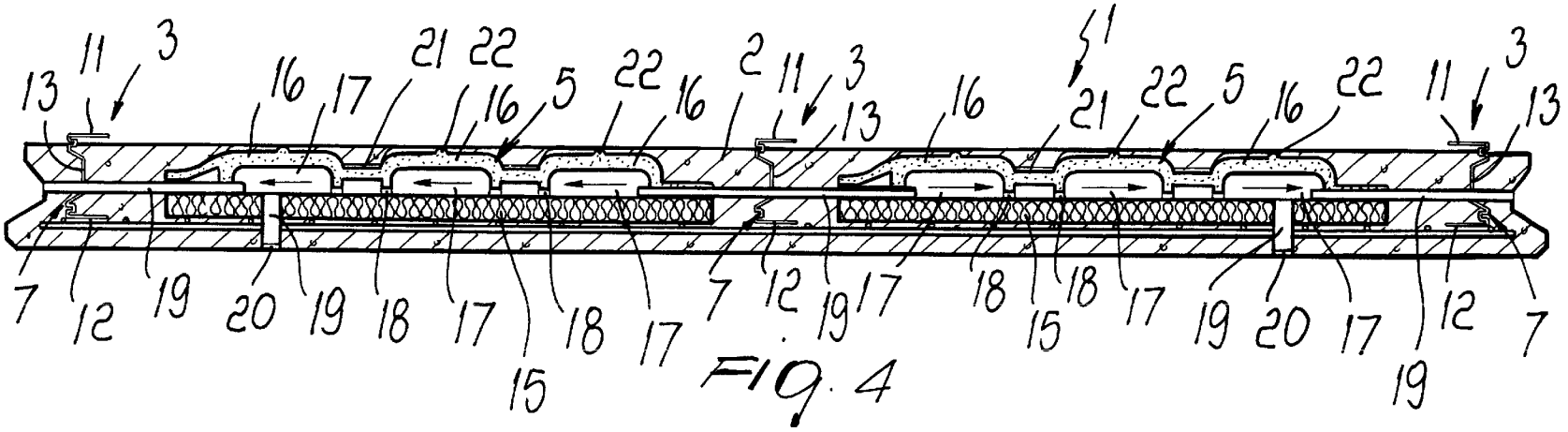
FIG. 4 is an enlarged-scale sectional view of FIG. 3, taken along the plane IV—IV.
Figure 5:
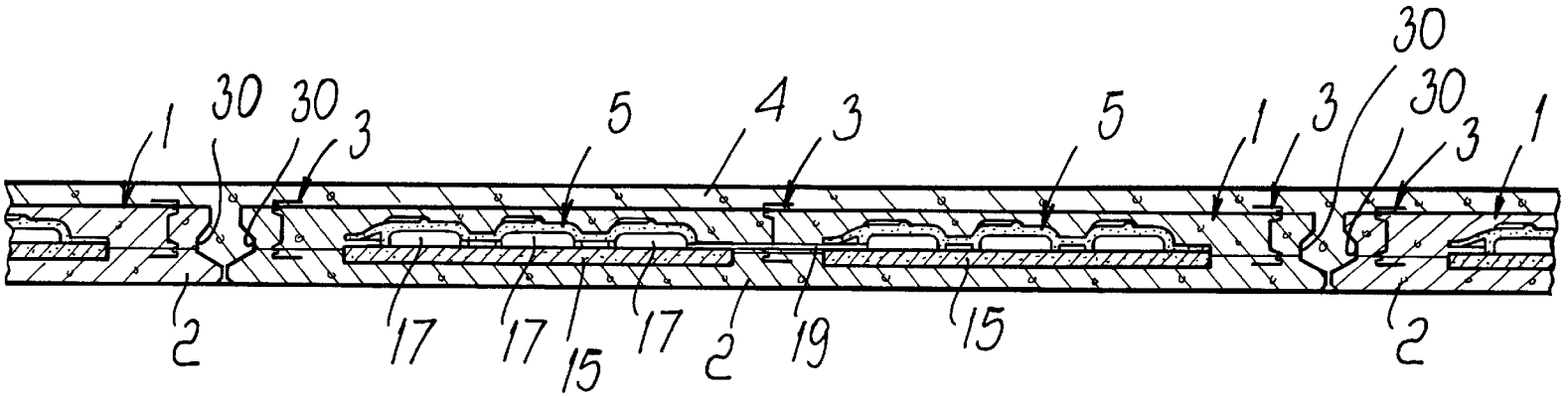
FIG. 5 is an enlarged-scale sectional view of FIG. 1, taken along the plane V—V.

With reference to the figures, the prefabricated panel according to the invention, generally designated by the reference numeral 1, comprises a concrete body 2 with a reinforcement 3 provided with portions which protrude from one of the larger faces of the panel body that constitutes the extrados of the floor and are meant to be embedded in the casting of the topping 4 of the floor.

Inside the panel body 2 there is at least one contoured sheet 5, made of thermally insulating material, preferably foamed polystyrene, which is interposed between the two larger faces of the panel body 2 and forms, between said two larger faces of the panel body 2, a ventilation chamber 6 which is composed of a plurality of mutually connected cells.

More particularly, the reinforcement 3 comprises longitudinal profiles 7 which are arranged on a plane which is substantially parallel to the two larger faces of the panel body and are orientated parallel to the larger sides of the panel. Substantially, the longitudinal profiles 7 are orientated at right angles to the two opposite sides of the panel that are meant to be rested on two beams 35 for supporting the floor.

Depending on the mechanical strength to be obtained for the panel, the reinforcement can be constituted exclusively by longitudinal profiles 7, as shown, or can also comprise transverse profiles, not shown for the sake of simplicity, which mutually connect the longitudinal profiles 7. In this case, the reinforcement of the panel is constituted by a frame-like structure.

The profiles 7 of the reinforcement of the panel according to the invention have a substantially C- or Σ-shaped transverse cross-section, with two end wings 11 and 12 which are arranged on planes which are parallel to each other and to the larger faces of the panel. The two end wings 11 and 12 are mutually connected by an intermediate wing 13.

One of the end wings, in the illustrated case the end wing 11, and a portion of the intermediate wing 13, starting from said end wing 11, protrude from the larger face of the panel body 2 that constitutes the extrados of the floor and are meant to be embedded in the casting of the topping 4.

The profiles 7 of the reinforcement 3 can have, along their extension, perforations and/or undulations in order to increase the anchoring of said profiles 7 in the concrete body 2 of the panel.

The panel according to the invention comprises a second sheet 15, preferably made of thermally insulating material, such as for example foamed polystyrene, which is substantially flat and faces the first sheet 5. The first sheet 5 and the second sheet 15 are arranged on planes which are parallel to the planes of arrangement of the two larger faces of the panel body, and said sheets delimit between them the ventilation chamber 6.

The first sheet 5 is shaped so as to form cups 16 which are arranged mutually side by side and form concave recesses 17 of the face of the first sheet 5 that faces the second sheet 15. The side of said recesses 17 that is directed toward the second sheet 15 is closed by the second sheet 15. The recesses 17, which constitute the cells into which the ventilation chamber 6 is divided, are mutually connected by means of connecting ducts which have smaller air passage sections than the recesses 17.

The connecting ducts are constituted by passages 18 formed in the edges of the cups 16 that are directed toward the second sheet 15.

The recesses 17 are further connected to at least one ventilation duct 19 which leads onto one of the outer sides of the panel.

According to requirements, it is possible to provide ventilation ducts 19 which lead onto the smaller faces of the panel or onto the larger faces of the panel.

Protective grilles 20 are conveniently arranged on the outlets of the ventilation ducts 19 and are meant to prevent the intrusion, inside the panel, of animals or dirt and can be actuated in order to adjust the flow of air in the ventilation chamber 6. The protective grilles 20 can further be provided with mechanical or manual means for adjusting their opening.

The cups 16 are delimited, on the face of the first sheet 5 that lies opposite the second sheet 15, by grooves 21 which are recessed with respect to the back of the cups, which instead protrudes from the face of the first sheet 5 that is directed away from the second sheet 15.

The presence of the grooves 21, which run both longitudinally and transversely, generates in the concrete layer of the body 2 of the panel that covers the face of the first sheet 5 a plurality of longitudinal and transverse ribs which increase the mechanical strength of the panel.

On the back of the cups 16 there are also protruding ribs 22 which preferably also affect the grooves 21 between the cups.

The ribs 22 preferably run diagonally with respect to the larger faces of the panel. More particularly, the cups 16 have a substantially rectangular base and the ribs 22 lie along a diagonal of the rectangular shape of the back of the cups 16.

The ribs 22 are designed to support an auxiliary reinforcement if it is provided; the auxiliary reinforcement is constituted by a net or by bars, which the ribs support so as to keep them correctly spaced from the remaining part of the first sheet 5, so as to obtain an excellent anchoring of the auxiliary reinforcement inside the concrete layer that covers the side of the first sheet 5 that lies opposite with respect to the second sheet 15.

An auxiliary reinforcement, constituted by a net or by bars, can also be provided in the layer of concrete that covers the side of the second sheet 15 that lies opposite with respect to the first sheet 5, in order to further increase the mechanical strength of the panel.

Preferably, the first sheet 5 and the second sheet 15 are made of foamed polystyrene, and in order to further increase the thermal insulation effect of these sheets their mutually facing faces can be covered with a reflective layer which can be constituted by a thin aluminum layer or synthetic layer, in any case a reflective one, which is applied to the mutually facing faces of the sheets 5 and 15.

Conveniently, the body 2 of the panel has recesses 30 on at least two of its smaller faces which are arranged on mutually opposite sides and which, in the floor, are meant to face contiguous panels; the recesses form undercuts for the anchoring of the concrete that constitutes the casting of the topping 4.

The recesses 30 obtain, for the casting of the topping 4, a plurality of ribs which in addition to increasing the anchoring of the casting of the topping 4 to the set of panels according to the invention that constitutes the floor, also increase the mechanical strength of the casting of the topping 4.

Advantageously, the larger face of the panel body 2 that constitutes the intrados of the floor is perfectly flat and can optionally be pre-finished with all the variations of surface treatment for panels for prefabricated building faces, for example bushhammered, sanded, on a pattern, with exposed stones, et cetera, depending on the requirements, or simply painted.

The body 2 of the panel can further have, according to requirements, through cutouts in order to provide openings in the floor.

Advantageously, inside the panel body 2 it is possible to embed, during the manufacture of the panel, inserts 31 which form grip regions for the lifting or movement of the panel. Such inserts can be constituted by plates, for example if the lifting device is of the type disclosed in U.S. Pat. No. 08/055,116 by the same Applicants, or by tubular bodies, for example if the lifting device is of the type disclosed in U.S. Pat. No. 6,092,849 by the same Applicants.

Figure 6:
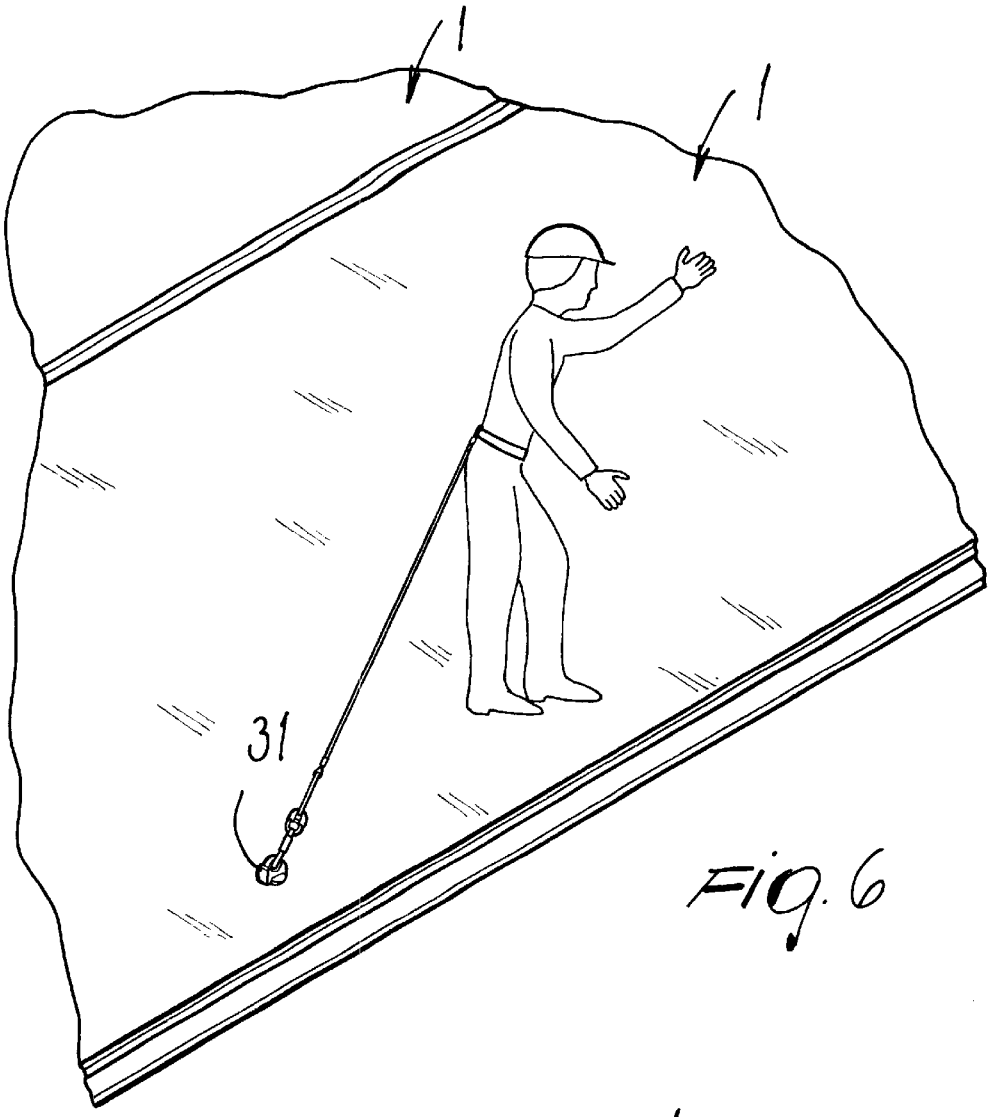
FIG. 6 is a view of the possibility of anchoring for an operator which is offered by the panel according to the invention.
Figure 8:
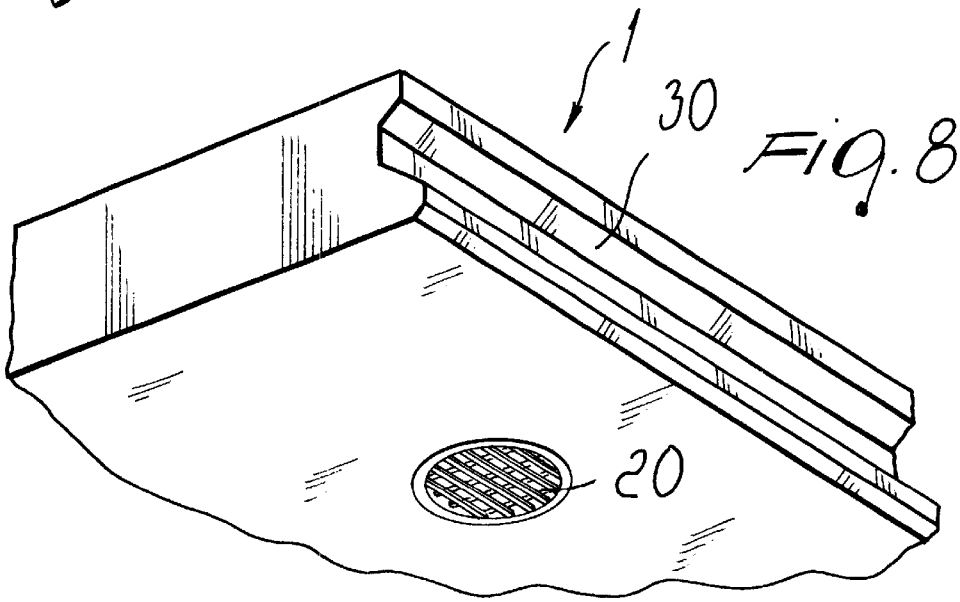
FIG. 8 is an enlarged-scale perspective view of a detail of the panel according to the invention.

These inserts, as well as optionally other inserts, can be used, as shown in particular in FIG. 6, as anchoring points for safety cables or harnesses in order to anchor the operators to the panel during the construction of the floor.

According to requirements, two opposite sides of the panel that are meant to be rested on the supporting beams 35 of the floor can be provided flat or with steps.

Construction of a floor by means of panels according to the invention is as follows.

As shown in particular in FIG. 1, the panels according to the invention are rested, with their two opposite transverse sides, on a pair of beams 35 and are arranged laterally to each other.

Directly after installation, the panels 1 are walkable and do not require, for their support, any propping in the underlying space. For this reason, the construction of buildings with floors provided by means of panels according to the invention is particularly simple and rapid, since the installation of the floors does not slow work inside the building.

Then the casting of the topping 4 is performed on the upper face of the panels, from which the wings 11 of the profiles 7 protrude, connecting the various panels to each other and completing the construction of the floor.

Figure 7:
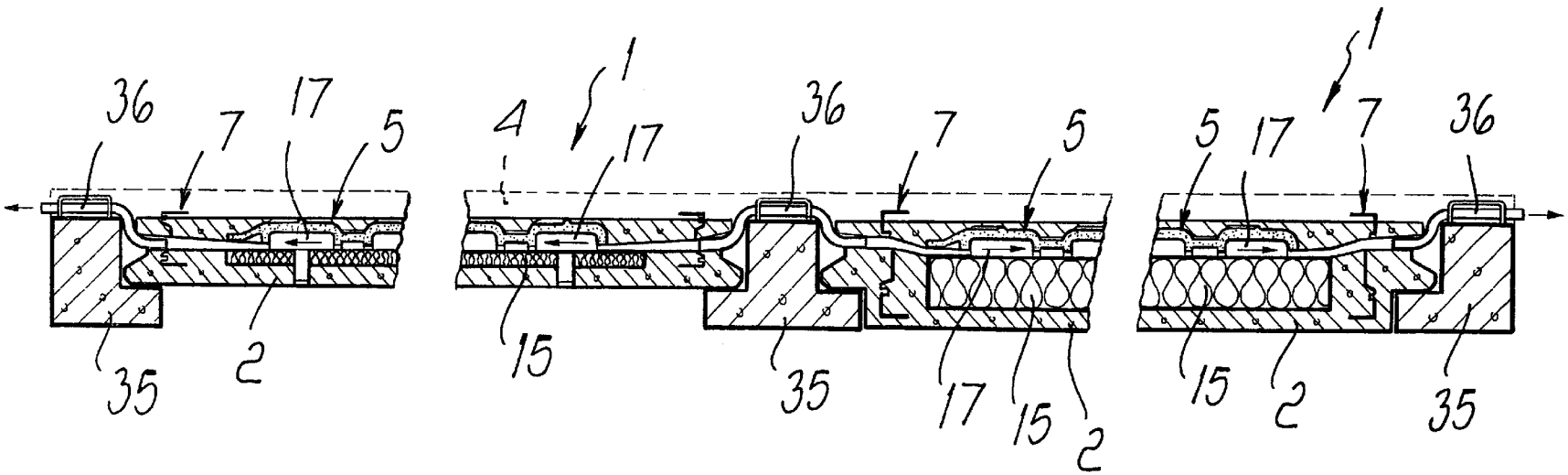
FIG. 7 is an enlarged-scale sectional view of FIG. 1, taken along the plane VII—VII.

It should be noted that before casting the topping the outlets of the ventilation ducts 19, arranged on the smaller faces of the panels, can be connected to each other and to the outside by means of tubes 36, and said tubes can optionally also surmount the beams 35, allowing the connection between the ventilation ducts 6 of panels arranged on the two opposite sides of a same beam 35, as shown in particular in FIG. 7.

In this manner, the various ventilation chambers 6 of the panels 1 that constitute the floor can be interconnected although the supporting beams 35 are present.

The panel according to the invention, by way of its particular structure, has a high mechanical strength which makes it self-supporting and walkable directly after installation, and therefore makes it particularly simple and rapid to build the entire floor.

Moreover, the presence of the sheets 5 and 15 and of the ventilation chamber 6 formed between the sheets and divided into a plurality of cells which are mutually connected, achieves, for the floor built with panels according to the invention, excellent thermal and acoustic insulation.

It should be noted that since the connection among the various cells that compose the ventilation chamber 6 is achieved by means of passages having a smaller cross-section than the recesses 17, which as a whole constitute the ventilation chamber 6, a reduction in the speed of the air that passes through the ventilation chamber 6 is achieved which still avoids the formation of condensation inside the panels but allows to achieve high effectiveness in thermal and acoustic insulation. It should also be noted that the distribution of the recesses 17, the connection among the ventilation chambers 6 of the various panels, and the optional arrangement of the outlets of the ventilation ducts 19 on the longitudinal sides and on the transverse sides of the panels according to the invention allows to obtain, for the floor, ventilation in a plurality of directions, as shown in FIG. 1, i.e., with a longitudinal flow and a transverse flow which ensure safe and optimum elimination of any moisture that might form inside the floor.

Owing to the fact that the panel according to the invention is not prestressed, such panel is extremely simple to manufacture and avoids the problems of longitudinal warping of the panel that are instead noticeable in prestressed panels. Moreover, again because of this fact, the reinforcement can have curvatures, changes in direction, localized reinforcements, et cetera, according to the requirements of overall and localized strength of the panel.

The presence of the ventilation chamber 6 inside the panel according to the invention, in addition to allowing to achieve excellent thermal and acoustic insulation, also allows to distribute heat in an optimum manner from the warmer regions to the colder regions of the panel, evening out the temperature of the entire panel and thus evening out all thermal expansions. The presence of the ventilation chamber 6 also allows to slow any overheating in case of fire, since the hot air and fumes produced by the fire find, in the ventilation chamber of each panel, a "stack" through which they can be evacuated toward the adjacent panel and so forth toward the outside.

In practice it has been observed that the panel according to the invention fully achieves the intended aim and objects, since it allows to provide floors with a flat intrados which have excellent mechanical strength, are immediately walkable even before the topping is cast, have excellent fire resistance and thermal and acoustic insulation and are free from condensation problems.

The panel thus conceived is susceptible of numerous modifications and variations, all of which are within the scope of the inventive concept; all the details may furthermore be replaced with other technically equivalent elements.

In practice, the materials employed, so long as they are compatible with the specific use, as well as the dimensions, may be any according to requirements and to the state of the art.

The disclosures in Italian Patent Application No. MI2000A000299 from which this application claims priority are incorporated herein by reference.

What is claimed is:

1. A prefabricated concrete panel for building floors in civil or industrial structures, comprising a concrete body with a reinforcement provided with portions which protrude from one of two larger faces of the body of the panel which constitutes extrados of a floor and are designed to be embedded in a casting of a topping of the floor, at least one first contoured sheet being provided inside the body of the panel, said sheet being made of thermally insulating material, being interposed between the two larger faces of the panel body and forming, between said two larger faces of the panel body, a ventilation chamber which is composed of a plurality mutually connected cells.

2. The panel according to claim 1, wherein said reinforcement comprises longitudinal profiles which are arranged on a plane which is substantially parallel to the two larger faces of the panel body and are orientated parallel to the larger sides of the panel.

3. The panel according to claim 2, wherein said reinforcement has a frame-like structure which is composed of said longitudinal profiles and of transverse profiles which mutually connect said longitudinal profiles.

4. The panel according to claim 2, wherein said profiles have a substantially C-shaped or Σ-shaped transverse cross-section with two end wings which are arranged on planes which are parallel to each other and to the larger faces of the panel, said end wings being connected by an intermediate wing; one of said two end wings and a portion of said intermediate wing protruding from one of the larger faces of the panel body that constitutes the extrados of the floor.

5. The panel according to claim 1, comprising a second sheet which is embedded in the concrete and faces said first sheet, said first and second sheets being arranged on planes which are parallel to planes of arrangement of the two larger faces of the panel body, said sheets delimiting said ventilation chamber between them.

6. The panel according to claim 5, wherein said first sheet is shaped so as to form mutually laterally adjacent cups which form concave recesses on the face of said first sheet that faces said second sheet, the side of said recesses that is directed toward said second sheet being closed by said second sheet; said recesses constituting said cells and being connected to each other by means of connecting ducts which have smaller air passage sections than said recesses.

7. The panel according to claim 6, wherein said recesses are mutually connected through passages formed in the edges of said cups that are directed toward said second sheet.

8. The panel according to claim 6, wherein said recesses are connected to at least one ventilation duct which has an outlet onto an outer side of the body of the panel.

9. The panel according to claim 8, wherein on the outlet of said at least one ventilation duct there is a protective grille.

10. The panel according to claim 9, wherein said protective grille is provided with means for adjusting its opening.

11. The panel according to claim 8, wherein the outlets of the ventilation ducts can be connected, by means of tubes, to the outlets of the ventilation ducts of contiguous panels in order to connect to each other, and to the outside, the ventilation chambers of the various panels that compose the floor.

12. The panel according to claim 6, wherein said cups are delimited, on the face of said first sheet that lies opposite said second sheet, by grooves which are recessed with respect to the back of said cups which protrudes from said face of the first sheet that is directed away from said second sheet.

13. The panel according to claim 12, wherein on the back of said cups there are protruding ribs for supporting reinforcement bars, or a net-like reinforcement, embedded in the concrete body of the panel.

14. The panel according to claim 13, wherein said protruding ribs also affect said grooves between said cups.

15. The panel according to claim 14, wherein said protruding ribs run diagonally with respect to the larger faces of the panel.

16. The panel according to claim 14, wherein said cups have a substantially rectangular base, said protruding ribs being arranged along a diagonal of the rectangular shape of the back of said cups.

17. The panel according to claim 5, wherein said second sheet is substantially flat.

18. The panel according to claim 5, wherein at least one of said first and second sheets is covered by a reflective layer on a face thereof that is directed toward the other one of said first and second sheet.

19. The panel according to claim 1, wherein the panel body has, on smaller faces thereof, recesses which form undercuts for anchoring of the concrete of the topping casting.

20. The panel according to claim 1, wherein the larger face of the panel body that constitutes the intrados of the floor is flat.

21. The panel according to claim 1, wherein the panel body has at least one through cutout.

22. The panel according to claim 1, comprising inserts which are embedded in the body of the panel and can be accessed from the outside of the panel, said inserts forming grip regions for lifting or moving the panel.

23. The panel according to claim 1, comprising inserts which are embedded in the panel body and can be accessed from the larger face of the panel body that constitutes the extrados of the floor, said inserts forming anchoring regions for safety cables or harnesses for operators.

* * * * *